US009560462B2

(12) United States Patent
Eriksen et al.

(10) Patent No.: US 9,560,462 B2
(45) Date of Patent: Jan. 31, 2017

(54) MICROPHONE TEST STAND FOR ACOUSTIC TESTING

(71) Applicant: Brüel & Kjær Sound & Vibration Measurement A/S, Nærum (DK)

(72) Inventors: Anders Eriksen, Værløse (DK); Erik Leon Ziegler, Værløse (DK)

(73) Assignee: Brüel & Kjær Sound & Vibration Measurement A/S, Nærum (DK)

( * ) Notice: Subject to any disclaimer, the term of this patent is extended or adjusted under 35 U.S.C. 154(b) by 202 days.

(21) Appl. No.: 14/366,376

(22) PCT Filed: Dec. 19, 2012

(86) PCT No.: PCT/EP2012/076140
§ 371 (c)(1),
(2) Date: Jun. 18, 2014

(87) PCT Pub. No.: WO2013/092706
PCT Pub. Date: Jun. 27, 2013

(65) Prior Publication Data

US 2014/0328489 A1 Nov. 6, 2014

Related U.S. Application Data

(60) Provisional application No. 61/578,467, filed on Dec. 21, 2011.

(51) Int. Cl.
*H04R 29/00* (2006.01)

(52) U.S. Cl.
CPC ..... *H04R 29/004* (2013.01)

(58) Field of Classification Search
CPC ..... H04R 29/004; H04R 29/00
USPC ..... 381/58
See application file for complete search history.

(56) References Cited

U.S. PATENT DOCUMENTS

2010/0290634 A1 11/2010 Schaule et al.

FOREIGN PATENT DOCUMENTS

| | | | |
|---|---|---|---|
| CN | 101336011 | A | 12/2008 |
| CN | 201403203 | Y | 2/2010 |
| CN | 201976252 | U | 9/2011 |
| DE | 102008015916 | B4 | 2/2011 |

(Continued)

OTHER PUBLICATIONS

International Search Report corresponding to co-pending International Patent Application Serial No PCT/EP2012/076140, European Patent Office, dated Feb. 28, 2013; (2 pages).

(Continued)

*Primary Examiner* — Paul S Kim
(74) *Attorney, Agent, or Firm* — Nixon Peabody LLP

(57) ABSTRACT

The present invention relates to a microphone test stand comprising a slide assembly with a microphone holder surrounded by a first acoustic sealing member. The slide assembly is movable in a first direction between a first position outside an acoustical chamber with an exposed state of the microphone holder and a second position inside the acoustical chamber in a shielded state of the microphone holder. An electrical connector comprises a set of electrical connector terminals which is connectable to a set of microphone terminals for receipt of a microphone response signal from a microphone assembly arranged in the microphone holder in response to a test sound pressure in the acoustical chamber.

24 Claims, 5 Drawing Sheets

(56) References Cited

FOREIGN PATENT DOCUMENTS

| | | | | | |
|---|---|---|---|---|---|
| GB | 1430485 | A1 | | 3/1976 | |
| JP | WO 2010026724 | A1 | * | 3/2010 | ..... G01H 17/00 |
| WO | 2009/118101 | A2 | | 10/2009 | |
| WO | 2010/026724 | A1 | | 3/2010 | |

OTHER PUBLICATIONS

Chinese Office Action corresponding to co-pending Chinese Patent Application, Chinese Patent Office, dated Jul. 19, 2016; (7 pages).

* cited by examiner

MICROPHONE TEST STAND FOR ACOUSTIC TESTING

CROSS-REFERENCE TO RELATED APPLICATIONS

This application is a U.S. National Stage of International Application No. PCT/EP2012/076140, filed Dec. 19, 2012, which claims the benefit of U.S. Provisional Patent Application No. 61/578,467, filed Dec. 21, 2011, both of which are incorporated herein by reference in their entireties.

The present invention relates to a microphone test stand comprising a slide assembly with a microphone holder surrounded by a first acoustic sealing member. The slide assembly is movable in a first direction between a first position outside an acoustical chamber with an exposed state of the microphone holder and a second position inside the acoustical chamber in a shielded state of the microphone holder. An electrical connector comprises a set of electrical connector terminals which is connectable to a set of microphone terminals for receipt of a microphone response signal from a microphone assembly arranged in the microphone holder in response to a test sound pressure in the acoustical chamber.

BACKGROUND OF THE INVENTION

Rapid and accurate acoustic testing of microphones or microphone assemblies such as miniature ECM or MEMS microphone assemblies is of continued interest to manufacturers of portable communication devices such as mobile phones. It is essential to verify that incoming microphone assemblies are both 100% functional and comply with prescribed electroacoustic test limits or standards before being mounted in the mobile phones or other portable communication equipment.

A microphone test stand performing such acoustic testing should be capable of delivering accurate, fast and reliable measurements under varying environmental conditions such as varying temperature, humidity and atmospheric pressure. It is furthermore advantageous if the microphone test stand in a simple manner can be adapted to different physical geometries of the microphone assemblies. For certain types of miniature microphone assemblies, it is also important to avoid any application of mechanical force or pressure to the microphone capsule or module during acoustic testing to obtain correct test results. It is further advantageous if the microphone assembly is completely surrounded by an applied test sound pressure inside an acoustical chamber of the microphone test stand, e.g. such that the test sound pressure is applied both frontal and rear sides of the microphone assembly.

To enable a large throughput of tested microphone assemblies it would further be beneficial if the microphone test stand comprises a microphone holder which can be transported between first position outside the acoustical chamber with an exposed state of the microphone holder and a second position inside the acoustical chamber in shielded state of the microphone holder. This feature allows a test operator or technician to rapidly and safely place and orient the microphone assembly as intended in the microphone holder in the exposed state before the microphone assembly is transported into the sealed acoustic chamber where the acoustic testing is performed. Clearly, during the acoustic testing the microphone holder and assembly should both be placed inside the sealed or sound-proof acoustical chamber to be isolated from environmental noise.

SUMMARY OF THE INVENTION

A first aspect of the invention relates to a microphone test stand comprising an acoustical chamber coupled to a speaker arranged to produce a test sound pressure in the chamber in accordance with a test signal. A slide assembly comprises a predetermined surface area having a microphone holder arranged thereon. The slide assembly is movable in a first direction between a first position outside the acoustical chamber at an exposed state of the microphone holder and a second position inside the acoustical chamber in a shielded state of the microphone holder. A first acoustic sealing member is surrounding the microphone holder in the shielded state thereof. An electrical connector comprising a set of electrical connector terminals which is connectable to a set of microphone terminals for receipt of a microphone response signal from a microphone assembly arranged in the microphone holder in response to the test sound pressure.

The test signal may be produced by a suitable signal source of a test system. The test system may comprise a properly adapted or programmed version of the PULSE measurement platform which is designed for sound and vibration measurement and available from the present applicant/assignee in a plurality of configurations. The test signal may form part of a predetermined or programmed test procedure comprising a plurality of individual test signals such as frequency response measurements in a predetermined frequency range, e.g. a range from 100 Hz to 15 kHz. The test signals may also comprise sensitivity measurements at one or more reference frequencies, distortion measurements, noise level measurements, etc. The test procedure applied to the microphone assembly under test is preferably predesigned by suitable programming of the test system. The microphone response signals may be supplied to the test system in either analog or digital format, e.g. as digital audio signal formatted in accordance with an industry standard protocol, depending on the characteristics of the particular type of microphone assembly under test. A volume of the acoustical chamber of the microphone test stand may vary depending on requirements to the chamber such as a useable frequency range or a maximum sound pressure. In some embodiments, the volume of the acoustical chamber is less than 2 $cm^3$, preferably less than 1 $cm^3$. These latter embodiments normally leave the acoustical chamber with sufficient small dimensions to allow extended high frequency response measurements to be performed in the chamber without exciting normal modes or resonant frequencies of the chamber.

The movable slide assembly enables rapid and safe execution of the acoustic test of the microphone assembly. A short test time is beneficial to keep added costs down, in particular for high-volume telecommunications microphones such as ECMs or MEMS types of miniature condenser microphone. In the exposed state of the microphone holder, both the microphone holder and the microphone assembly are preferably operator accessible allowing a test operator or technician to manually place the microphone assembly in the microphone holder and visually check that the assembly in properly oriented or positioned therein. Thereafter, the slide assembly can be displaced or transferred to the second position inside the acoustical chamber to provide the shielded state or protected state of the microphone holder and microphone assembly. The slide assembly may be manually, semi-automatically or fully automatically displaced or translated to the second position, e.g. in a linear manner guided by a rail or other guiding structure. In one embodiment, the slide assembly comprises a drawer like structure with the microphone holder arranged on a horizontal upper surface thereof. In this embodiment, the slide assembly is preferably translated in essentially horizontal direction by manipulating a handle mounted thereon. Another embodiment of the microphone test stand, the slide assembly comprises piston like structure that is vertically translatable. The microphone holder is arranged on a horizontal distal end surface of the piston like structure which is translated vertically during testing. Yet an embodiment of the microphone test stand comprises a plurality of individual slide assemblies that are mounted on a shared frame or holder structure for example an elongate container or a rotatable carousel. In this embodiment, each of the individual slide assemblies may be preloaded with a microphone assembly prior to the mounting of the holder structure on the microphone test stand. During testing, the individual slide assemblies may be vertically oriented and displaced from the first position to the second position and vice versa one by one until each microphone assembly of the entire collection of slide assemblies held in the shared frame or carousel have been tested The acoustical chamber preferably forms an acoustically sealed chamber in the shielded state of the slide assembly. This may be achieved by mounting the first acoustic sealing member on the predetermined surface area of the slide assembly surrounding the microphone holder, or mounting the first acoustic sealing member on a fixed or movable housing structure enclosing the acoustical chamber such that the first acoustic sealing member surrounds the microphone holder. In both instances, the design or geometry of the slide assembly may be configured such that the predetermined surface area forms a wall section of the acoustical chamber in the shielded state of the slide assembly. The predetermined surface area is preferably arranged inside a perimeter of the first acoustic sealing member. The movable housing structure, the first sealing member and the predetermined surface of the slide assembly may be brought into abutment or physical contact in the shielded state of the slide assembly to acoustically seal the acoustical chamber against the external environment. The first sealing member preferably comprises a wear-resistant elastomeric material e.g. synthetic rubber copolymer to provide good acoustic sealing over many operational cycles of the slide assembly.

Another embodiment utilizes displacement of a movable housing structure, enclosing the acoustical chamber, to provide a sealing mechanism for the acoustical chamber once the slide assembly has reached its second position. In this embodiment, the movable housing structure is movable in a second direction substantially transversal to the first direction;

wherein the movable housing structure is movably arranged between:

a) an inactive position lacking acoustic sealing of the acoustical chamber at the second position of the slide assembly; and b) an active position where the acoustical chamber, the first sealing member and the predetermined surface area of the slide assembly are abutted to form an acoustically sealed chamber at the second position of the slide assembly.

The displacement distance of the movable housing structure between the active and inactive positions may be lie between 3 mm and 20 mm such as between 5 mm and 10 mm. The skilled person will understand that the movement between the active position and the inactive position may be effected by manual actuation of a handle or grip structure attached to, or interacting with, the movable housing structure or by semi-automatic or fully automatic operation accomplished by a suitable actuator or motor mechanism. In one embodiment, the first acoustic sealing member is mounted on the predetermined surface area of the slide assembly; and a second sealing member is mounted on the movable housing structure and surrounding an aperture of acoustical chamber, preferably a downwardly facing aperture. The second sealing member has a shape mating to the first sealing member such that the first and second sealing members are brought in abutment in the active position of the movable housing structure. The first and second sealing members are therefore brought in physical contact in the active position of the movable housing structure. In this embodiment, the abutment between the first and second sealing members may provide the desired acoustic sealing of the acoustical chamber while the predetermined surface area of the slide assembly inside the perimeter of the first acoustic sealing member forms part of the wall structure of the acoustical chamber e.g. a bottom or side wall surface of the chamber.

The set of electrical connector terminals may have different shapes and dimensions depending on mechanical and electrical characteristics of the set of microphone terminals that are to be contacted. The electrical connector terminals may for example comprise a set of poke pins or a set of substantially flat pads depending on the characteristics of the microphone terminals. The microphone terminals may comprises a set of exposed gold covered pads arranged on a carrier of the microphone assembly, such as a printed circuit board or ceramic substrate, that are suitable for being contacted by an appropriately aligned set of poke pins. In one preferred embodiment of the invention, the electrical connector comprises an anisotropic elastomeric member with the set of electrical connector terminals formed as respective electrical connector pads arranged in a predetermined pattern on a surface of the anisotropic elastomeric member. The electrical connector pads are electrically isolated from each other in a first direction, e.g. horizontally, by non-conducting material of the elastomeric member. In a second direction, preferably transversal to the first direction, the material of the elastomeric member becomes conductive under pressure. The anisotropic elastomeric member provides a highly flexible electrical connection mechanism to establish electrical connections between individual microphone terminals of the microphone assembly and the electrical connector pads of the connector due to the capability of adapting the locations of electrical conductive pathways to a variable geometry or pattern of the microphone terminals of the microphone assembly. Different types of microphone assemblies use different layout geometries or patterns of the microphone terminals but the anisotropic elastomeric member provided in the present connector embodiment automatically adapts positions of electrical conductive pathways to fit the specific layout or geometry of the microphone terminals. In this manner, a single type of electrical connector can be used to test different microphone types with differing physical layouts or patterns of the microphone terminals. In one embodiment, the electrical connector comprises an elongate strip of flexible printed circuit board which is separate from the anisotropic elastomeric member. A distal end section or area of the elongate strip of flexible printed circuit board comprises the set of electrical connector pads. The distal end section of the electrical connector is brought into physical contact with the surface of the anisotropic elastomeric member such that electrical connection is established between each electrical connector pad and a corresponding surface region of the surface of the anisotropic elastomeric member. The physical contact between the distal end section of the electrical connector and the anisotropic elastomeric member may for example be established by pressure from the movable housing structure once the latter is displaced to its active position where it may contact the distal end section of the electrical connector and the anisotropic elastomeric member. According to one such embodiment, the anisotropic elastomeric member is arranged at the outside perimeter of the first sealing member such that the microphone terminals of the microphone assembly protrude from the inside to the outside of the perimeter of the first sealing member. This embodiment is particularly well-suited for acoustic testing of the microphone assemblies which comprise an elongate carrier strip such as a strip of flexible printed circuit board with the microphone terminals arranged at one end of the flexible printed circuit board. The flexible printed circuit board may form a carrier structure for a microphone transducer element or microphone capsule such as a MEMS transducer element. The strip of flexible printed circuit board may be sufficiently thin to run across the first sealing member without introducing any significant acoustical leak from the sealed acoustic chamber. In particular if the first sealing member, or possibly both of the first and second sealing members, comprise(s) an elastomeric material. In this manner, the position of the microphone assembly may be fixed by the first sealing member, or possibly both of the first and second sealing members, during acoustic test in the active position of the movable housing structure.

In yet another preferred embodiment of the present microphone test stand, the acoustical chamber comprises a sound tube having a first opening arranged inside the acoustical chamber and a second opening arranged outside the acoustical chamber. A probe microphone is coupled to the second opening of the sound tube to detect the test sound pressure and/or a calibration sound pressure in the chamber. A sound conduit or channel is formed in the sound tube or pipe such that the test sound pressure is transmitted through the sound conduit from the first opening inside the acoustical chamber to the probe microphone located at the second opening. The cross-sectional profile of the sound conduit or channel may have various shapes such as circular, elliptical, quadratic etc. A cross-sectional area of the sound conduit or channel is preferably less than 3.14 $mm^2$, preferably less than 2 $mm^2$ to minimize acoustical loading effects on the acoustical chamber and keep the effective volume of the acoustical chamber down. In one embodiment, the microphone test stand further comprising an acoustical impedance matching member arranged at the second opening of the sound tube. The acoustical impedance matching member eliminates, or at least suppresses, generation of acoustical transmission line reflections from a far or distal end of the sound tube near the second opening and further minimizes acoustical loading of the acoustical chamber by the probe microphone arrangement. The acoustical impedance matching member may comprise a coiled sound tube.

The probe microphone may advantageously be adapted to monitor or calibrate the sound pressure inside the acoustical chamber. By monitoring the sound pressure inside the acoustical chamber, the test system may be adapted to detect and compensate for changes in acoustic or electrical properties of the test loudspeaker, power amplifiers and other electronic components or devices of the test system. The monitoring of the sound pressure inside the acoustical chamber may be performed during acoustic test of the microphone assemblies and/or "off-line" during dedicated sound calibration procedures. In both instances, accurate test sound pressure is maintained over time despite changing environmental parameters and changing electrical or acoustical characteristics of the components of the microphone test stand and/or test system.

The probe microphone preferably comprises a reference microphone having a well-defined acoustic sensitivity and frequency response in accordance with an individual calibration chart. These types of reference microphones are available from several manufacturers together with calibration charts and other data documenting acoustic parameters of the individual reference microphone and its sensitivity to changes in environmental conditions such as atmospheric pressure, temperature and humidity. The reference microphone comprise may comprise one or more standardized outer dimension(s) mating to a coupling member of a sound calibrator or pistonphone such that the microphone sensitivity can be accurately calibrated at one or more reference frequencies via a specific type of calibrator. In one exemplary embodiment, the reference microphone comprises a probe microphone type 4182 available from the manufacturer Brüel & Kjær Sound and Vibration Measurement A/S. The provision of the sound tube allows the reference microphone to be placed some distance away from the acoustical chamber which is an advantageous feature because the distal placement allows the above-mentioned types of reference microphones to be used as probe microphone. The accurate or well-defined acoustic sensitivity of these types of reference microphones together with their well-documented response to changes in environmental conditions, such as atmospheric pressure, temperature and humidity, allow the test system to maintain a highly accurate calibration of the test sound pressure.

How the microphone assembly under test is fixed to the slide assembly during acoustic testing may have significant influence on validity of the measured microphone response signals. For certain types of miniature microphone assemblies it is important to avoid any application of mechanical pressure or force to the microphone capsule of the microphone assembly during acoustic testing to ensure validity of the measured microphone response signals. The lack of mechanical pressure or force on the microphone capsule avoids that acoustic leakages between the microphone capsule and a carrier material of the microphone assembly are masked or overlooked by the acoustic test, in particular if the force is applied substantially transversal to a diaphragm plane of the microphone capsule. In one embodiment of the invention, the microphone holder therefore comprises a cavity shaped and sized to fix a position of the microphone assembly on the slide assembly. This cavity may advantageously be shaped and sized to contact one or more edge surfaces of the microphone capsule or transducer element of the microphone assembly. The entire microphone capsule may project into the cavity and be kept in place by the one or more edge surfaces abutting against one or more corresponding wall structures of the cavity. In this manner, the microphone assembly can be maintained in a well-defined position on the slide assembly without applying any mechanical pressure or force to the microphone capsule.

According to yet another preferred embodiment of the microphone holder, the holder is shaped and sized to convey the test sound pressure to a rear side of the miniature microphone assembly and to a frontal side of the miniature microphone assembly. This may be achieved by providing suitable acoustic leaks around at least one of the edge surfaces of the microphone capsule along a wall structure of the cavity such that the test sound pressure is allowed to travel around the microphone assembly and reach both a top and rear side thereof.

A second aspect of the invention relates to a method testing miniature microphone assemblies comprising steps of:

a) placing a slide assembly at a first position outside an acoustical chamber with an exposed state of a microphone holder,
b) mounting a miniature microphone assembly in the microphone holder of the slide assembly,
c) displacing the slide assembly in a first direction to a second position with the microphone holder arranged inside an acoustical chamber,
d) applying a test signal to a speaker arranged to produce a test sound pressure in the acoustical chamber,
e) recording a response signal from the microphone assembly in response to the test sound pressure.

The method of testing miniature microphone assemblies may be automatically started by the test system in response to a control signal from a sensor, e.g. a switch mounted on the microphone test stand. The switch may be activated by the movable housing structure once the latter reaches the active position. In the latter situation, the first and second sealing members may have been brought in abutment to provide a sealed state of the acoustical chamber. The recording of the response signal from the microphone assembly is preferably performed by a computerized test system e.g. build around a personal computer such as a laptop computer. The personal computer will often provide very huge signal storage capacity for recordation of response signals from individual microphone assemblies such that response data for a vast amount of microphone assemblies can be stored and possibly analysed. To ensure that each microphone assembly is functional and performs to certain prescribed standards, the testing methodology preferably comprises a further step of:

f) comparing the response signal recorded from the microphone assembly to one or more predetermined test limits. The test limits may comprise upper and lower frequency response limits, noise limits, distortion limits etc. The test limits are preferably pre-stored on the personal computer such that each microphone assembly immediately after the test procedure is finalized can be flagged as "OK" or "failure" depending on whether or not the test limits were exceeded.

In one embodiment of the testing methodology, the slide assembly and a movable housing structure are both displaced, albeit in transversal directions, from an initial or loading state of the test stand, where the microphone holder is in the exposed state, to an active position ready for acoustic testing. According to this embodiment, after step c) recited above, the method comprises a further step of:

g) displacing the movable housing structure enclosing the acoustical chamber from an inactive position at an unsealed state of the acoustical chamber to an active position with a sealed state of the acoustical chamber; wherein the movable housing structure is displaced in a second direction substantially transversal to the first direction. In one such embodiment, the slide assembly may be displaced in a substantially horizontal direction while the movable housing structure is displaced in vertical direction.

The testing methodology may comprise a further step of:

h) displacing a set of electrical contact terminals of an electrical connector to contact a set of microphone terminals to establish electrical contact to the microphone assembly. As explained in detail above, the shape and dimension of the set of electrical connector terminals may vary considerably depending on the mechanical and electrical characteristics of the microphone terminals that are to be contacted.

Another embodiment of the testing methodology comprises a further step of:

i) contacting and fixing a position of an elongate electric contact member of the miniature microphone assembly by the first acoustic sealing member surrounding the microphone holder and movable housing structure. As previously explained, the elongate electric contact member may comprise an elongate strip of flexible printed circuit board which forms a carrier structure for the microphone transducer element or capsule. The elongate electric contact member may be placed in the microphone holder by the operator such that one end of the electric contact member protrudes outside of the perimeter of the first acoustic sealing member. The end of the elongate electric contact member may comprise a set of electrically exposed microphone terminals allowing these to be contacted by corresponding electrical pads or terminals of the connector of the test assembly such that the microphone response signals are accessible outside the sealed acoustical chamber formed inside the perimeter of the first acoustic sealing member. As mentioned above, the connector may comprise an anisotropic elastomeric member providing the electrical pads or terminals of the connector in which case the method comprises a further step of:
k) contacting the set of electrically exposed microphone terminals with the anisotropic elastomeric member comprising a set of electrical connector pads arranged in a predetermined pattern on a surface of the anisotropic elastomeric member.

BRIEF DESCRIPTION OF THE DRAWINGS

Preferred embodiments of the invention will be described in more detail in connection with the appended drawings, in which.

DETAILED DESCRIPTION OF PREFERRED EMBODIMENTS

Figure 1:
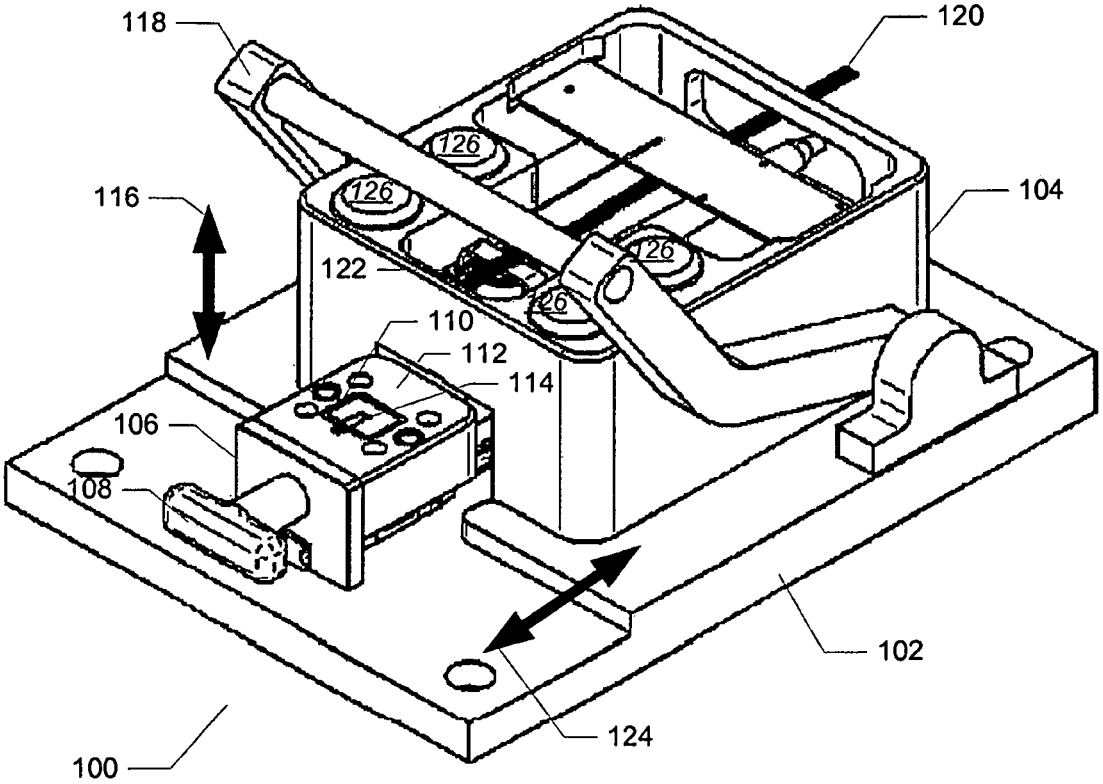
FIG. 1 is a perspective view of a microphone test stand in accordance with a first embodiment of the invention, FIGS. 2*a*)-*b*) are schematic illustrations of the construction and operation of a slide assembly in accordance with the first embodiment of the invention.

FIG. 1 is a perspective view of a microphone test stand 100 in accordance with a first embodiment of the invention. The microphone test stand comprises a frame 102 supporting a vertically movable (i.e. in the directions indicated by arrow 116) housing structure 104 enclosing an acoustical chamber (not shown). The housing structure 104 is vertically movable, as indicated by the arrow 116, by actuation of a handle 118 pivotally coupled to the frame 102 through a pair of bearings. Four vertically oriented pillars or rods 126 guide vertical movement of the housing structure 104. A slide assembly 106 comprises an upper surface 112 comprising a microphone holder (not shown) engaging and fixing a position of a miniature microphone assembly 114, preferably in form of a MEMS or ECM based microphone assembly as described in additional detail below. The microphone holder (not shown) and a portion of the MEMS microphone assembly 114, comprising a microphone capsule, are surrounded by a first acoustic sealing member 110. The first acoustic sealing member 110 may comprise an elastomeric material with good wear resistance such as a synthetic rubber copolymer for example Nitrile butadiene rubber (NBR). An elongate electric contact member of the MEMS microphone assembly 114 projects to the outside of a surface area of the upper surface 112 enclosed by the first acoustic sealing member 110. The slide assembly 106 is movable in a substantially horizontal direction as indicated by arrow 124 between the illustrated first or proximate position where the MEMS microphone assembly 114 is arranged outside of the acoustical chamber enclosed by the housing structure 104. In the proximate state, the microphone holder is arranged in an exposed, or operator accessible, state which allows the operator to manually place the MEMS microphone assembly 114 in the microphone holder and visually check that the assembly is properly oriented or positioned therein. In a second or distal position, the slide assembly 106 is positioned inside the acoustical chamber to provide a shielded state or protected state of the microphone holder and MEMS microphone assembly 114. The slide assembly 106 is either manually, semi-automatically or fully automatically translated in a linear manner in the horizontal direction until the front surface, carrying or supporting handle 108, is substantially aligned with a front surface of the housing structure 104. In this second or distal position of the slide assembly 106, the housing structure 104 is initially arranged in an inactive position without physical contact between the acoustical chamber and the first sealing member 110 on upper surface 112 of the slide assembly 106. In the inactive position of the movable housing structure 104, it may rest between 3 and 20 mm, such as between 5 and 10 mm, above the frame 102 and sliding member 106 higher than in the active state. To improve acoustic isolation of the acoustic test chamber, a second sealing member (not shown) is mounted on the movable housing structure 104 such that the second sealing member surrounds a downward facing aperture of the acoustical chamber. The second sealing member has a shape mating to the first sealing member 110 on the slide assembly 106 such that the first and second sealing members are brought in physical contact when the movable housing structure 104 is lowered to the active position. The operator may actuate the handle 118 such that the housing structure 104 is lowered, i.e. translated towards the frame 102 in the vertical direction indicated by the arrow 116, until the housing structure 104 reaches the active position where the first and second sealing members are brought in abutment or physical contact to form an acoustically sealed test chamber.

In this active state, the microphone test stand 100 is ready to perform the desired acoustic testing of the MEMS microphone assembly 114. The MEMS microphone assembly 114 is properly positioned oriented inside the acoustically sealed test chamber such that a well-defined test sound pressure can be applied thereto by the speaker arranged in the top-portion of the test chamber. The skilled person will understand that a predetermined test procedure may be initiated automatically once the movable housing structure 104 is lowered to its active position and the microphone holder and MEMS microphone assembly 114 are placed in the shielded state by the slide assembly 106. The automatic start of the predetermined test procedure may be initiated by the test system in response to a control signal from a sensor, e.g. a switch mounted on the microphone test stand 100. The skilled person will understand that in the alternative, the predetermined test procedure may be initiated manually by the operator. After completion of the test procedure, the operator may manually lift the handle 118 upwardly such that the movable housing structure 104 is lifted to its inactive position and thereafter manually retract the slide assembly 106 to its first position by the handle 108 where the MEMS microphone assembly 114 is exposed. The tested MEMS microphone assembly 114 is thereafter removed from the microphone holder, placed in an appropriate container and a new sample inserted therein and the acoustic test started over again.

The test sound pressure is produced in accordance with a test signal applied by a power amplifier coupled to the speaker 122. The actual test sound pressure produced within the acoustically sealed test chamber may be monitored by a monitor microphone during testing as described in further detail below. The test signal may be produced by a suitable signal source of a test system. The test system may comprise a properly adapted or programmed version of the PULSE measurement platform which is designed for sound and vibration measurement and available from the present applicant/assignee in a plurality of configurations. The test signals may comprise frequency response measurements in the range 100 Hz to 15 kHz, sensitivity measurements, distortion measurements, noise level measurements, etc. The test procedure applied to each sample of the MEMS microphone assembly 114 is preferably predesigned by suitable programming of the test system such that a suite of different test signals are applied automatically to the MEMS microphone assembly 114 and microphone response signals either in analog or digital form recorded by the test system. The microphone response signals are transmitted from the microphone assembly through an electrical cable 120, e.g. a flat elongate piece of flexPCB, to the test system which is coupled to a distal portion of the electrical cable 120. An opposite or proximal end of the electrical cable 120, comprises an electrical connector with a set of electrical connector pads which are connectable to a set of microphone terminals arranged on an elongate flat piece of flexible printed circuit (113 refer to FIG. 3 below) of the MEMS microphone assembly 114. In this manner, the electrical cable 120 is adapted to carry or conduct the measured microphone response signals to the test system for recording and processing. The electrical cable 120 and accompanying electrical connector pads may in addition to carrying the measured microphone response signals to the test system include additional electrical connections carrying other types of signals from the test system or from the microphone test stand 100 to the MEMS microphone assembly 114. These signals may include a DC bias voltage for the MEMS microphone capsule and/or a clock signal for a digital MEMS microphone assembly 114 which includes an analog-to-digital converter and other clocked circuitry.

Figure 2:
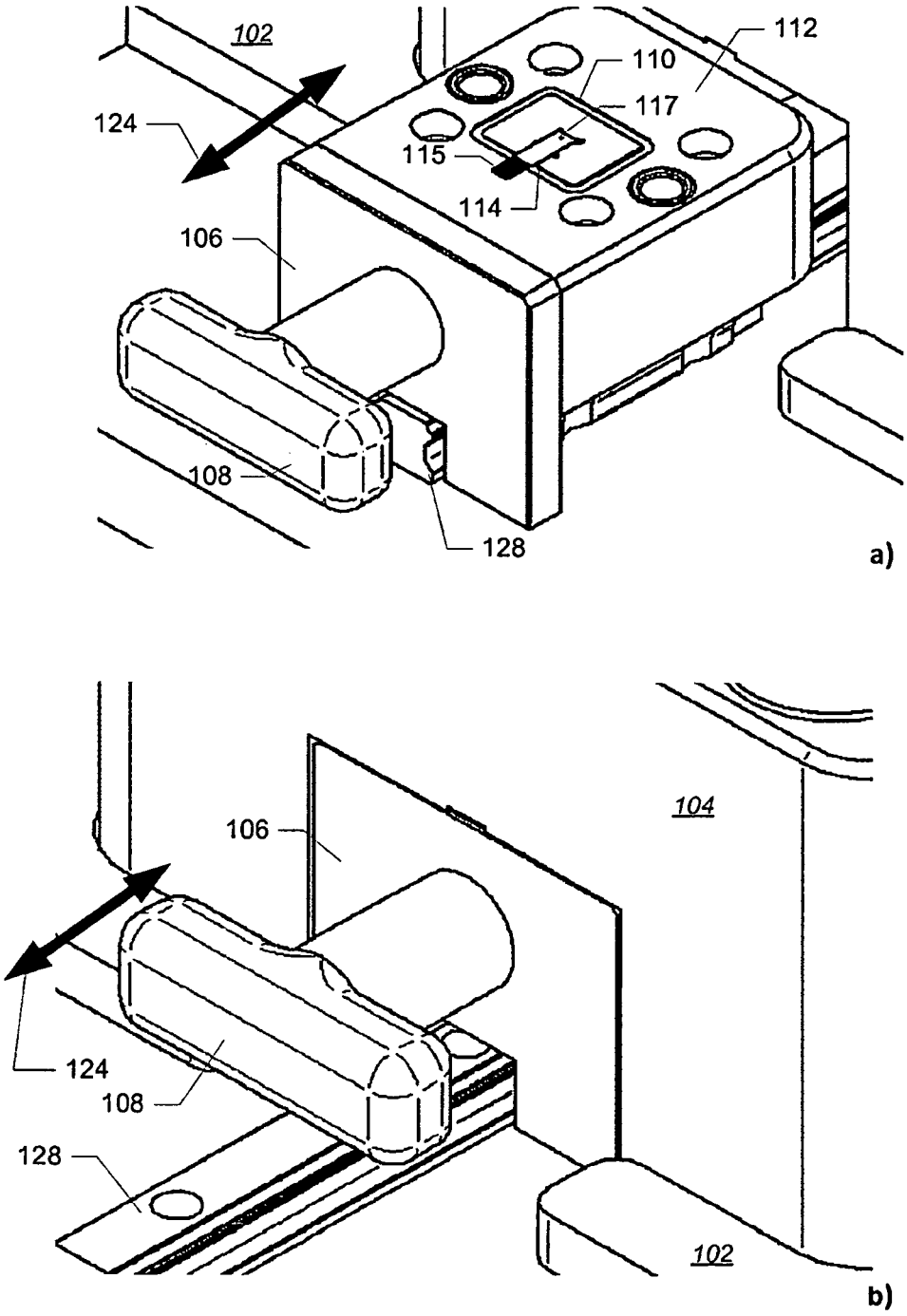

FIGS. 2*a*)-*b*) are schematic illustrations of the construction and operation of the slide assembly 106 described above. In FIG. 2*a*), the slide assembly 106 is arranged in the first or proximate position where the microphone holder and MEMS microphone assembly 114 is arranged in the exposed, or operator accessible, state outside the acoustical chamber (not shown). The microphone holder comprises a cavity or cut-out (refer to item 117 of FIG. 3 below—hidden by the MEMS microphone assembly 114) in the upper surface 112 of the slide assembly 106 inside the perimeter of the sealing ring 110. The cavity is shaped and sized to contact at least a part of a surface or edge perimeter of the microphone transducer element or capsule (not shown) so as to substantially fix a position of the MEMS microphone assembly 114 on the slide assembly 106. The microphone transducer element is placed on a downward facing surface of the MEMS microphone assembly 114 such that the transducer element projects into the cavity and becomes invisible in the illustrated view. The illustrated view shows a rear surface of the MEMS microphone assembly 114. However, the rear surface of the MEMS microphone assembly 114 comprises a small sound port or inlet 117 through which the test sound pressure can propagate to the microphone transducer element. As previously-mentioned, the MEMS microphone assembly 114 comprises an elongate strip of flexible printed circuit board that forms a carrier structure for the microphone transducer element. A distal end section 115 of this elongate strip of flexible printed circuit board protrudes to the outside of the perimeter of the first sealing member 110. The distal end section 115 comprises a set of electrically exposed microphone terminals which are connectable to the corresponding pads or terminals of the set of electrical connector pads arranged in an end section of on the electrical connector 120. This electrical connection is established through an anisotropic elastomeric member (refer to item 121 of FIG. 3) as explained in further detail below.

Once the operator has appropriately placed the MEMS microphone assembly 114 in the microphone holder as described above, the slide assembly 106 is transported to its second position inside the acoustical chamber in the shielded state of the microphone holder as depicted on FIG. 2*b*). The slide assembly 106 may be transported by substantially linear motion guided by a rail 128 or other type of guiding mechanism. The skilled person will understand that the slide assembly 106 may be transported manually or automatically to its second position. In the second position of the slide assembly 106, the vertical frontal surface of the movable housing structure 104 is aligned to a vertical frontal surface of the slide assembly with the handle 108 left projecting outwardly.

Figure 3:
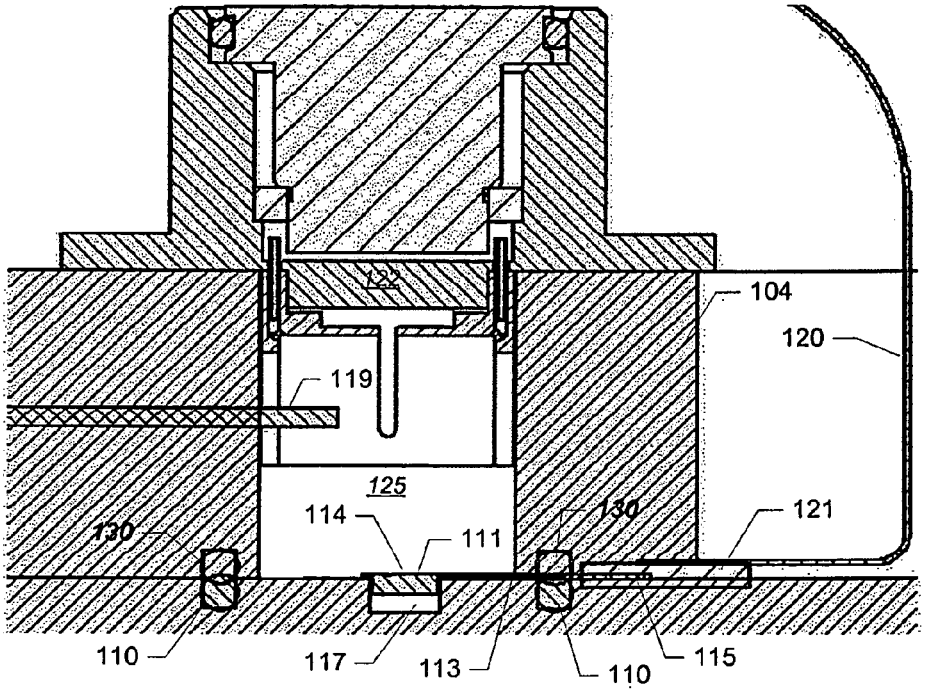
FIG. 3 is a central vertical cross-section view through the microphone test stand depicted on FIG. 1.

FIG. 3 is a central vertical cross-sectional view through an upper portion of the microphone test stand 100 depicted on FIG. 1 in the active position of the movable housing structure 104. The central vertical cross-sectional view is made through a central portion of the acoustical chamber 125. The loudspeaker 122 is arranged in an uppermost portion of the acoustical chamber 125 to supply the test sound pressure therein. The loudspeaker 122 may comprise a PVDF-foil speaker which has good high-frequency sound reproducing properties when coupled to a closed cavity such as the present the acoustical chamber 125. The loudspeaker 122 is preferably designed to provide substantial sound pressure at least up to a frequency of 15 kHz, and preferably higher. Together with appropriately chosen dimensions of the acoustical chamber 125 this allows the high-frequency response of the MEMS microphone assembly 114 to be accurately determined.

A microphone transducer element 111 of the MEMS microphone assembly 114 is placed in the cavity 117 of the microphone holder as described above. The second sealing member 130 is arranged on a downward facing surface of the movable housing structure 104 such that its surrounds or encloses an aperture of the acoustical chamber 125. The second sealing member 130 makes physical contact to the first sealing member 110 arranged on the slide assembly 106 around the entire perimeter of the acoustical chamber 125 in the depicted active position such that an essentially acoustically sealed chamber is formed. The acoustic sealing is beneficial in attenuating or supressing the transmission of environmental noise sounds to the chamber and interfering with the test sound pressure applied to the MEMS microphone assembly 114 during the test procedure.

The second sealing member 130 preferably comprises the same material the first sealing member 110, e.g. a synthetic rubber copolymer like Nitrile butadiene rubber (NBR).

The previously-mentioned elongate strip of flexible printed circuit board 113 that serves as the carrier structure for the microphone transducer element 111 projects in-between the two otherwise abutted first and second sealing members 110, 130. The elastomeric nature of these first and second sealing members 110, 130 allows these to fixate the position and orientation of the elongate strip of flexible printed circuit board 113 on the slide assembly without damaging it. A distal end section 115 of the elongate strip of flexible printed circuit board 113 accordingly protrudes to the outside of the perimeter of the first and second sealing members where the distal end section 115 contacts the anisotropic elastomeric member 121. As mentioned above, the distal end section 115 comprises a set of electrically exposed microphone terminals. Electrical connections are now established to the corresponding pads or terminals of the set of electrical connector pads arranged in the end section of on the electrical connector 120 through the anisotropic elastomeric member 121. Under pressure from the downward facing surface of the movable housing structure 104, a plurality of electrical pathways or conductors are established vertically through the anisotropic elastomeric member 121 forming electrical connections between the vertically aligned electrical terminals or pads of the set of electrically exposed microphone terminals and respective pads of the set of electrical connector pads arranged on the electrical connector 120. Consequently, the electrical cable 120 is now capable of carrying or conducting the measured microphone response signals to the test system for recording and processing due to the electrical pathways formed in the anisotropic elastomeric member 121.

To monitor or calibrate the sound pressure inside the acoustical chamber 125, a sound pipe or tube 119 protrudes from a side-wall section of the acoustical chamber 125. An opening of a sound conduit or channel inside the sound tube 119 projects centrally into the chamber 125 and transmits the test sound pressure, or possibly a calibration sound pressure, inside the chamber 125, to a probe microphone (not shown) coupled to a second opening at the opposite end of the sound tube 119 to allow detection of the sound pressure in question. The cross-sectional profile of the sound conduit or channel 119 may have various shapes such as circular, elliptical, quadratic etc. A cross-sectional area of the sound conduit or channel is preferably less than 3.14 $mm^2$, preferably less than 2 $mm^2$. The provision of the sound conduit or channel allows the probe microphone to be placed some distance away from the acoustical chamber 125. This is an advantageous feature of the present embodiment because it allows a high-precision measurement or reference type of microphone to be used as probe microphone. This would otherwise be prohibited by the relatively large (compared to dimensions of miniature telecom microphones such as MEMS or electret microphones) dimensions of this type of microphones. In one embodiment, the reference microphone comprises a probe microphone type 4182 available from the manufacturer Brüel & Kjær Sound and Vibration Measurement A/S. The accurate or well-defined acoustic sensitivity of this type of reference microphone together with its well-documented response to changes in environmental conditions, such as atmospheric pressure, temperature and humidity, allow the test system to maintain a highly accurate calibration of the test sound pressure. Thereby, changes in acoustic or electrical properties of the test loudspeaker and electronic components or devices of the test system can be compensated.

Figure 4:
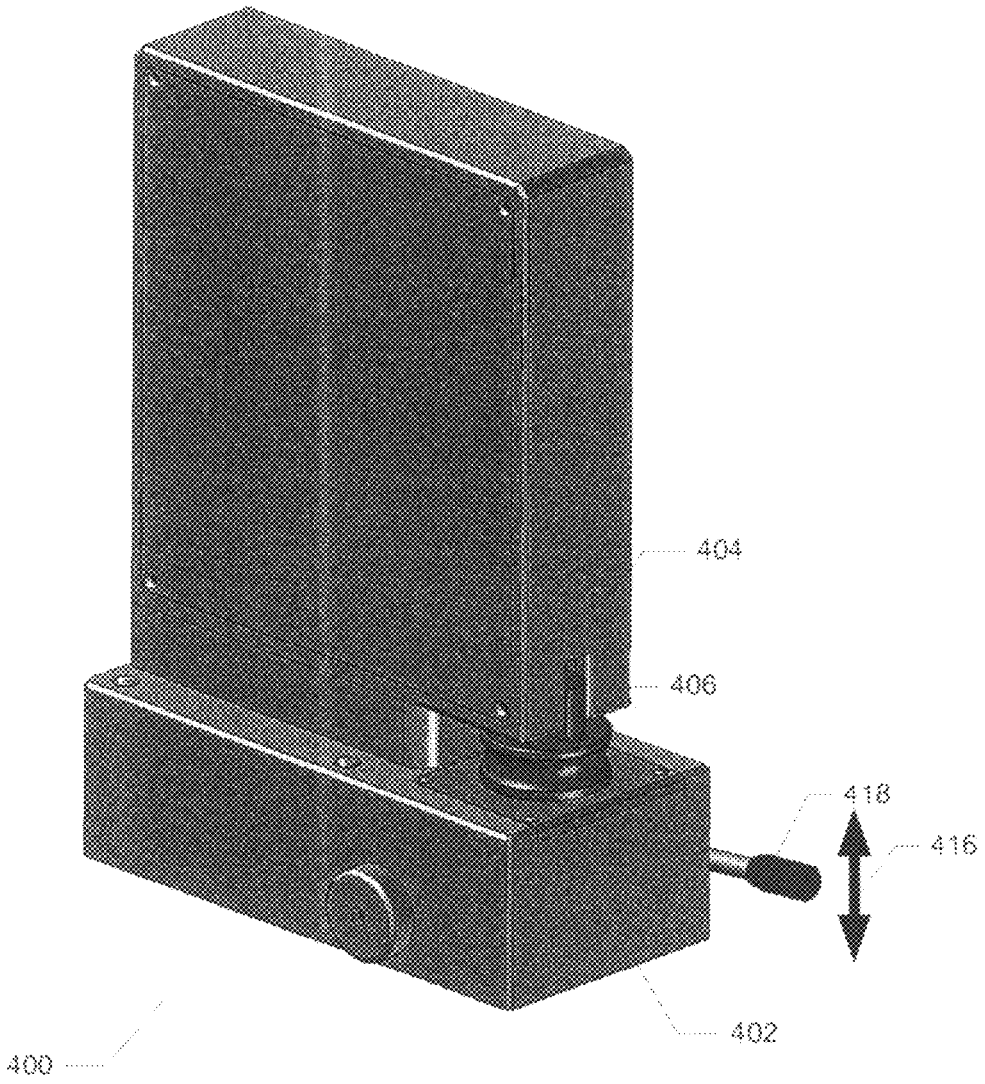
FIG. 4 is a perspective view of a microphone test stand in accordance with a second embodiment of the invention.

FIG. 4 is a perspective view of a microphone test stand 400 in accordance with a second embodiment of the invention. The microphone test stand 400 comprises a frame 402 supporting a stationary housing structure 404 enclosing an acoustical chamber (not shown). A vertically (i.e. along arrow 416) translatable slide assembly comprises a piston like structure 406. An upper end surface (not shown) of the piston like structure 406 supports a microphone holder (not shown) as discussed below in further detail in connection with FIG. 5.

The piston like structure 406 of the slide assembly is movable in a substantially vertical direction as indicated by arrow 416 between the illustrated first or proximate position where the microphone holder is situated outside of the acoustical chamber enclosed within the housing structure 404. In the proximate position, the microphone holder is arranged in an exposed state outside the acoustic test chamber, but without convenient operator access—opposite to the situation for the above-discussed first embodiment of the invention. Hence, to provide operator access to the microphone holder, the slide assembly 406 is manually or automatically removed from the microphone test stand 400 and placed on a suitable support such that the microphone holder becomes visible and operator accessible. In this removed position of the slide assembly the operator is able to manually place the microphone assembly in the microphone holder for example aided by a suitable pick-and-place tool. The operation can subsequently visually check that the microphone assembly is properly oriented or positioned therein. Thereafter, the operator (or robot) grabs the slide assembly and returns it to the proximate position on the microphone test stand 400. The operator may now proceed to actuate a handle 418 in the vertical direction indicated by arrow 416 such that the piston like slide portion 406 is raised while the housing 404 of the microphone test stand remains stationary. In response, the piston like slide portion 406 is translated in vertical direction towards the housing structure 404 until the slide assembly reaches an active or distal position where the microphone holder and microphone assembly are appropriately positioned inside the acoustical chamber to provide a shielded state or protected state of the microphone holder.

In this active state, the microphone test stand 400 is ready to perform the desired acoustic testing of the microphone assembly 114 in a manner similar to the one de described previously in connection with the first embodiment of the microphone test stand 100.

Figure 5:
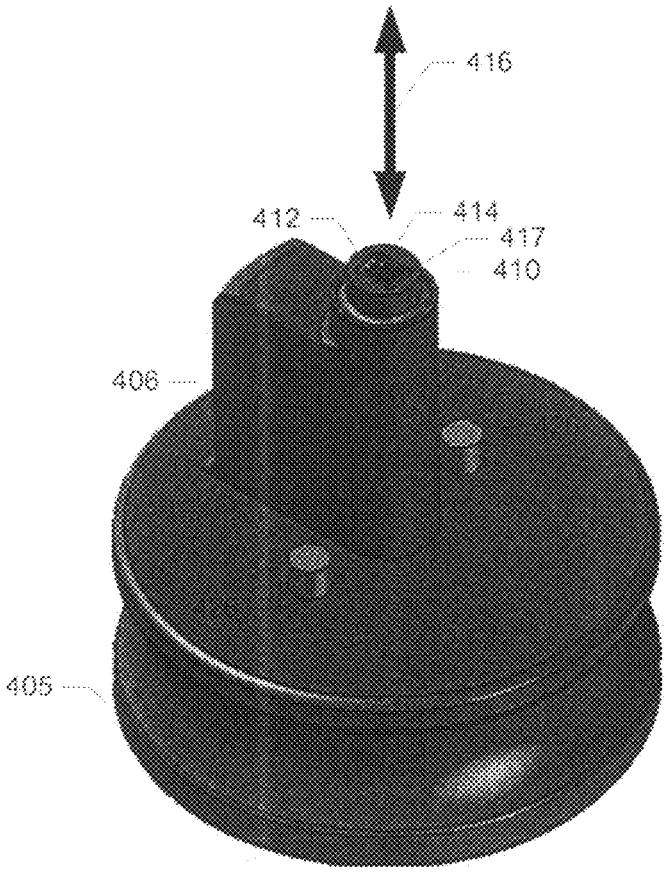
FIG. 5 is a perspective view of a slide assembly with a piston like structure for use in the microphone test stand in accordance with the second embodiment of the invention.

FIG. 5 is a perspective view of the slide assembly, comprising the piston like structure 40, for use in the microphone test stand 400. The entire slide assembly can be disconnected from the microphone test stand 400 during acoustical testing. The piston like structure 406 is mounted on a carrier structure 405 of the slide assembly. A pair of vertically projecting rods 426 fits into a pair of mating guiding holes of the housing 404 to guide vertical movement of the entire structure. A microphone holder comprises a cavity or cut-out 417, partly hidden from view by a MEMS microphone assembly 414. The microphone holder 417 is arranged in an upper or distal end surface 412 of the piston like slide assembly 406. The cavity of microphone holder is shaped and sized to contact at least a part of a surface or edge perimeter of the microphone transducer element or capsule (not shown) so as to substantially fix a position of the MEMS microphone assembly 414 on the piston like slide assembly 406. A sealing ring 410 is arranged on a circumferential shoulder of the piston-like slide assembly 406 and may comprise anyone of the previously discussed materials.

The MEMS microphone assembly 414 comprises a carrier with 3-5 exposed upwardly oriented microphone pads (not shown) that carry power supply voltage, clock signals, digital audio output signals etc. from/to the microphone test stand 400. The microphone test stand 400 comprises a suitable electrical connector (not shown) that establishes electrical connection to the microphone pads. The electrical connector may for example comprise a set of poke pins that automatically are brought in mechanical and electrical contact with respective ones of the 3-5 exposed microphone pads when the piston-like slide assembly 406 is moved to the second position. Hence, in the present embodiment of the microphone test stand 400, the electrical connector is arranged inside the acoustical test chamber.

The invention claimed is:

1. A microphone test stand comprising:

an acoustical chamber coupled to a speaker arranged to produce a test sound pressure in the chamber in accordance with a test signal, a slide assembly comprising a predetermined surface area having a microphone holder arranged thereon, the slide assembly being movable in a first direction between a first position outside the acoustical chamber at an exposed state of the microphone holder and a second position inside the acoustical chamber in a shielded state of the microphone holder, a first acoustic sealing member surrounding the microphone holder in the shielded state thereof, an electrical connector comprising a set of electrical connector terminals connectable to a set of microphone terminals for receipt of a microphone response signal from a microphone assembly arranged in the microphone holder in response to the test sound pressure, a sound tube having a first opening arranged inside the acoustical chamber and a second opening arranged outside the acoustical chamber, a probe microphone coupled to the second opening of the sound tube to detect the test sound pressure.

2. A microphone test stand according to claim 1, wherein the first acoustic sealing member is mounted on:

the predetermined surface area of the slide assembly, or a movable housing structure enclosing the acoustical chamber.

3. A microphone test stand according to claim 2, wherein the predetermined surface area of the slide assembly forms a wall section of the acoustical chamber in the second position of the slide assembly, the predetermined surface area being arranged inside a perimeter of the first acoustic sealing member.

4. A microphone test stand according to claim 2, wherein the movable housing structure is movable in a second direction substantially transversal to the first direction;

wherein the movable housing structure is movably arranged between:

a) an inactive position lacking acoustic sealing of the acoustical chamber at the second position of the slide assembly; and b) an active position where the acoustical chamber, the first sealing member and the predetermined surface area of the slide assembly are abutted to form an acoustically sealed chamber at the second position of the slide assembly.

5. A microphone test stand according to claim 4, wherein the first acoustic sealing member is mounted on the predetermined surface area of the slide assembly; and a second sealing member is mounted on the movable housing structure and surrounding an aperture of acoustical chamber, wherein the second sealing member has a shape mating to the first sealing member such that the first and second sealing members are brought in abutment in the active position of the movable housing structure.

6. A microphone test stand according to claim 1, wherein the electrical connector comprises an anisotropic elastomeric member where the set of electrical connector terminals comprises a set of electrical pads arranged in a predetermined pattern on a surface of the anisotropic elastomeric member.

7. A microphone test stand according to claim 6, wherein the anisotropic elastomeric member, when pressurized along the second direction, becomes electrical conductive in the second direction and electrically insulating in the first direction.

8. A microphone test stand according to claim 7, wherein the anisotropic elastomeric member is arranged in-between the movable housing structure and the slide member such that pressure is applied to the anisotropic elastomeric member in the active position of the movable housing structure.

9. A microphone test stand according to claim 8, wherein the anisotropic elastomeric member is arranged at outside a perimeter of the first sealing member.

10. A microphone test stand according to claim 1, wherein the probe microphone comprises a reference microphone having a well-defined acoustic sensitivity and frequency response in accordance with an individual calibration chart.

11. A microphone test stand according to claim 10, wherein the reference microphone comprises one or more standardized outer dimension(s) mating to a coupling member of a sound calibrator or pistonphone.

12. A microphone test stand according to claim 1, wherein a cross-sectional area of a sound conduit or channel in the sound tube is less than 3.14 mm.sup.2, or less than 2 mm.sup.2.

13. A microphone test stand according to claim 1, further comprising an acoustical impedance matching member arranged at the second opening of the sound tube.

14. A microphone test stand according to claim 1, wherein the microphone holder comprises a cavity shaped and sized to fix a position of the microphone assembly on the slide assembly.

15. A microphone test stand according to claim 14, wherein the cavity of the microphone holder is shaped and sized to contact one or more edge surfaces of a microphone capsule of the microphone assembly.

16. A microphone test stand according to claim 1, wherein the microphone holder is shaped and sized to convey the test sound pressure to a rear side of the miniature microphone assembly and a frontal side of the miniature microphone assembly.

17. A microphone test stand according to claim 1, wherein the acoustical chamber has a volume less than 2 $cm^3$, or less than 1 $cm^3$.

18. A microphone test stand according to claim 1, wherein the speaker comprises a PVDF foil speaker.

19. A method testing miniature microphone assemblies comprising steps of:

a) placing a slide assembly at a first position outside an acoustical chamber with an exposed state of a microphone holder, b) mounting a miniature microphone assembly in the microphone holder of the slide assembly, c) displacing the slide assembly in a first direction to a second position with the microphone holder arranged inside an acoustical chamber, d) applying a test signal to a speaker arranged to produce a test sound pressure in the acoustical chamber, e) recording a response signal from the microphone assembly in response to the test sound pressure, e1) arranging a sound tube having a first opening inside the acoustical chamber and a second opening outside the acoustical chamber, e2) coupling a probe microphone to the second opening of the sound tube to detect the test sound pressure.

20. A method testing miniature microphone assemblies according to claim 19, comprising a further step of:

f) comparing the response signal recorded from the microphone assembly to one or more predetermined test limits.

21. A method testing miniature microphone assemblies according to claim 19, comprising after step c) a further step of:

g) displacing a movable housing structure enclosing the acoustical chamber from an inactive position at an unsealed state of the acoustical chamber to an active position with a sealed state of the acoustical chamber;

wherein the movable housing structure is displaced in a second direction substantially transversal to the first direction.

22. A method testing miniature microphone assemblies according to claim 19, comprising a further step of:

h) displacing a set of electrical contact terminals of an electrical connector such as poke pins to contact a set of microphone terminals to establish electrical contact to the microphone assembly.

23. A method testing miniature microphone assemblies according to claim 19, comprising a further step of:

i) contacting and fixing a position of an elongate electric contact member of the miniature microphone assembly by the first acoustic sealing member surrounding the microphone holder and movable housing structure.

24. A method testing miniature microphone assemblies according to claim 22, wherein the elongate electric contact member comprises a set of electrically exposed microphone terminals; the method comprising a further step of:

j) contacting the set of electrically exposed microphone terminals with an aniso-tropic elastomeric member comprising a set of electrical connector pads arranged in a predetermined pattern on a surface of the anisotropic elastomeric member.

* * * * *